US005752440A

United States Patent [19]

Schaum

[11] Patent Number: 5,752,440

[45] Date of Patent: May 19, 1998

[54] DEVICE FOR EXCHANGING A NUMBERING CYLINDER OF A NUMBERING AND IMPRINTING UNIT OF A ROTARY PRINTING PRESS

[75] Inventor: Frank Schaum, Heidelberg, Germany

[73] Assignee: Heidelberger Druckmaschinen Aktiengesellschaft, Heidelberg, Germany

[21] Appl. No.: 642,117

[22] Filed: May 2, 1996

[30] Foreign Application Priority Data

May 3, 1995 [DE] Germany ..... 195 16 150.5

[51] Int. Cl.[6] ..... B41L 47/46

[52] U.S. Cl. ..... 101/91; 101/216; 101/479

[58] Field of Search ..... 101/76, 77, 91, 101/92, 216, 219, 247, 144, 145, 477, 479

[56] References Cited

U.S. PATENT DOCUMENTS

| | | | |
|---|---|---|---|
| 4,024,812 | 5/1977 | Jahn | 101/76 |
| 4,262,590 | 4/1981 | Bruckner | 101/76 |
| 4,572,069 | 2/1986 | Schwarzbeck | 101/76 |
| 4,833,988 | 5/1989 | Sugiyama et al. | 101/247 |
| 4,848,265 | 7/1989 | Komori | 101/76 |

FOREIGN PATENT DOCUMENTS

| | | |
|---|---|---|
| 2221343 | 11/1973 | Germany . |
| 3407681 | 9/1985 | Germany . |

*Primary Examiner*—Eugene H. Eickholt

*Attorney, Agent, or Firm*—Nils H. Ljungman and Associates

[57] ABSTRACT

A device to facilitate the insertion and removal of a numbering cylinder of a numbering and imprinting unit for a rotary printing press is taught. The numbering and imprinting unit has a retractable inking unit. The numbering cylinder is removable from between the printing press side frames. The numbering cylinder is removably mounted in bearing and drive parts disposed in the printing press side frames.

20 Claims, 3 Drawing Sheets

DEVICE FOR EXCHANGING A NUMBERING CYLINDER OF A NUMBERING AND IMPRINTING UNIT OF A ROTARY PRINTING PRESS

BACKGROUND OF THE INVENTION

1. Field of the Invention

The present invention relates to a device for exchanging a numbering cylinder of a numbering and imprinting unit of a rotary printing press, with the numbering cylinder being engageable at an impression cylinder, and with an inking unit for inking the figures and/or the printing blocks being retractable as a unit from the numbering cylinder, with bearing and drive parts for the numbering cylinder being firmly disposed in the printing press side frames and being connectable to the shaft of the numbering cylinder.

2. Background Information

Such an embodiment is known from the German publication 22 21 343 C3, which is equivalent to U.S. Pat. No. 4,024,812, in which both the numbering cylinder and the inking unit may be manually removed by the pressman from the printing press. Furthermore German Patent No. 34 07 681 C2, which is equivalent to U.S. Pat. No. 4,572,069, discloses a device for exchanging a numbering cylinder, which device features a complicated mechanism for removing both the numbering cylinder and the inking unit.

OBJECT OF THE INVENTION

Proceeding from this state of the art it is the object of the present invention to facilitate the manual removal and insertion of the numbering cylinder with simple means, even in view of unfavorable space availability of the printing press.

SUMMARY OF THE INVENTION

According to the present invention this object is achieved in that supporting and guiding elements, by means of which the shaft journals of the numbering cylinder may be moved to the bearing parts in the printing press, are secured on both inner sides of the printing press side frame. This solution easily permits the insertion of the numbering cylinder in the printing press, and its removal therefrom, and prevents a shock contact with parts provided inside the printing press, thus avoiding any damage to the printing press parts.

An advantageous embodiment of the present invention is characterized in that the supporting and guiding elements are designed as guide rails which, with the numbering cylinder being inserted, feature half-shell-type recesses for the two shaft journals of the numbering cylinder and adjacent conveying inclinations directed downwards over which the numbering cylinder may be moved into its mounting position. Thus, the pressman may easily insert the numbering cylinder in the half-shell-type recesses, even given unfavorable space availability, move it into its mounting position and connect it to the bearing parts. During the removal the process is effected vice versa, providing the possibility of cleaning the cylinder, with the cylinder being in the half-shell-type recesses, and exchanging parts, respectively. This is possible even in the case of a heavy and fully equipped numbering cylinder.

One feature of the invention resides broadly in a printing press with a device for installing and removing a numbering cylinder, the printing press comprising: printing press side frames; the printing press side frames comprising element for supporting components of the printing press; sheet feed element being disposed on the printing press side frames; an impression cylinder being disposed on the printing press side frames; a plate cylinder being disposed on the printing press side frames; a first inking mechanism being disposed on the printing press side frames; the first inking mechanism comprising element for inking the plate cylinder; a blanket cylinder being disposed on the printing press side frames; a numbering cylinder being removably disposed on the printing press side frames; bearing element for removably mounting the numbering cylinder on the printing press side frames; element for moving the numbering cylinder between an installed position and a removed position; the installed position of the numbering cylinder being on the bearing element; a second inking mechanism being disposed on the printing press side frames; the second inking mechanism comprising element for inking the numbering cylinder; the moving element comprising element for supporting and guiding the numbering cylinder between the installed position and the removed position; the element for supporting and guiding being fixedly disposed on the printing press side frames; the printing press side frames comprising inner surfaces, the inner surfaces being disposed adjacent the numbering cylinder in the installed position; the element for supporting and guiding being fixedly disposed on the inner surface of the printing press side frames; the element for supporting and guiding comprising at least one stationary surface; the numbering cylinder comprising shaft journals; the shaft journals being disposed on the bearing element in the installed position; and the at least one stationary surface being disposed for and comprising element for permitting sliding of the journals on the at least one stationary surface.

Another feature of the invention resides broadly in a numbering and imprinting unit for a printing press, the printing press comprising side frames for supporting components of the printing press, the numbering and imprinting unit comprising: a numbering cylinder; bearing element for mounting the numbering cylinder on the printing press side frames and for permitting removal of the numbering cylinder from the printing press side frames; element for moving the numbering cylinder between an installed position and a removed position; the installed position of the numbering cylinder being on the bearing element; the moving element comprising element for supporting and guiding the numbering cylinder between the installed position and the removed position; and element for fixedly disposing the support and guide element on the printing press side frames.

A further feature of the invention resides broadly in a device for installing and removing a numbering cylinder of a numbering and imprinting unit for a printing press, the printing press comprising side frames for supporting components of the printing press, the printing press side frames comprising inner surfaces, the numbering and imprinting unit comprising: a numbering cylinder; the numbering cylinder comprising shaft journals; bearing element for mounting the shaft journals of the numbering cylinder on the printing press side frames and for permitting removal of the numbering cylinder from the printing press side frames; the device for installing and removing a numbering cylinder comprising: element for moving the numbering cylinder between an installed position and a removed position; the shaft journals of the numbering cylinder being disposed on the bearing element in the installed position; the numbering cylinder being disposed adjacent the inner surfaces of the printing press side frames in the installed position; the moving element comprising element for supporting and guiding the numbering cylinder between the installed position and the removed position; element for fixedly disposing the support and guide element on the inner surfaces of the printing press side frames; the element for supporting and guiding comprising at least one stationary surface; and the at least one stationary surface being disposed for and comprising element for permitting sliding of the journals on the at least one stationary surface.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

A specimen embodiment of the invention is schematically illustrated in the drawings.

DESCRIPTION OF THE PREFERRED EMBODIMENT

Figure 1:
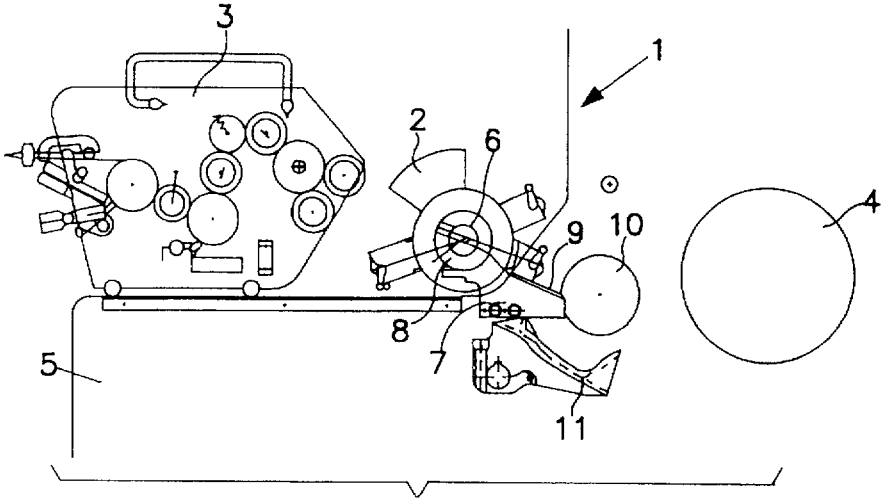
FIG. 1 is a side elevational view of a numbering unit comprising a retracted inking unit and a numbering cylinder having been removed from the printing press.

FIG. 1 shows a numbering and imprinting unit 1 consisting of a numbering cylinder 2 and an inking unit 3, with the inking unit 3 shown in a retracted position and with the numbering cylinder 2 removed from its position on the impression cylinder 4. Guide rails 7 designed as supporting and guiding elements for the shaft journals 6 of the numbering cylinder 2 are screwed to the inner sides of the printing press side frames 5, which guide rails 7 feature, in the upper parts thereof, half-shell-type recesses 8 (see FIGS. 2 and 3, also) for the two shaft journals 6 of the numbering cylinder 2. The numbering cylinder 2 shown in FIG. 1 is in its upper position. In this position the pressman may easily insert the numbering cylinder in the printing press and remove it therefrom, respectively.

Figure 2:
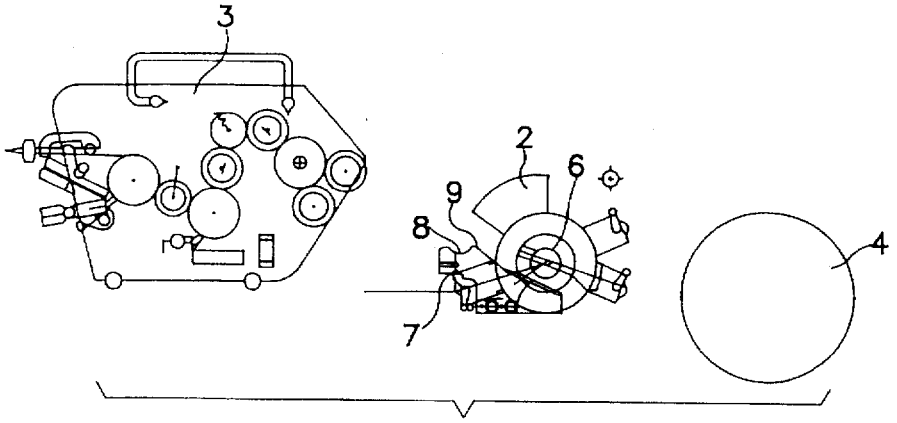
FIG. 2 is a side elevational view of a numbering unit, with the numbering cylinder being inserted in its mounting position.
Figure 3:
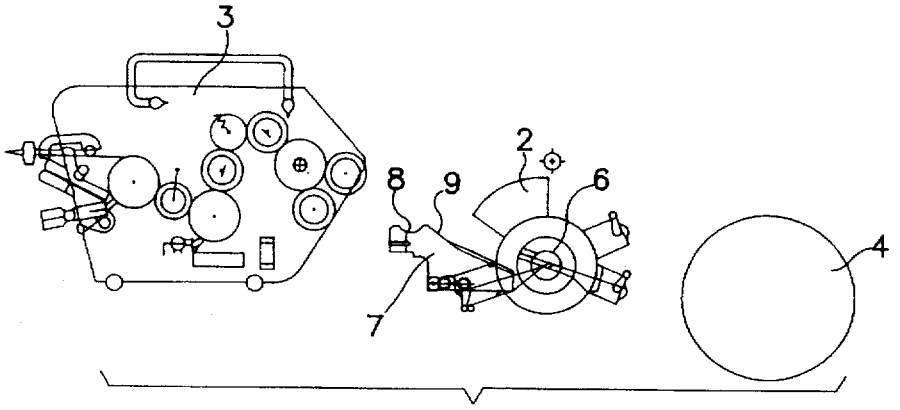
FIG. 3 is a side elevational view of a numbering unit, with the numbering cylinder being in its mounting position between the printing press side frames.

The half-shell-type recesses 8 for the two shaft journals 6 are followed by downwardly directed conveying inclinations 9 on which the journals 6 slide and the numbering cylinder 2 may be moved into mounting position 10. FIG. 2 shows the numbering cylinder 2 in its moving phase, and the numbering cylinder 2 shown in FIG. 3 is in its mounting position on the impression cylinder 4. This relatively exact guidance of the numbering cylinder 2 can avoid collisions with, for example, control cams 11 (shown in FIG. 1) during the insertion, which control cams 11 are provided between the printing press side frames 5. This solution can permit an easy removal of the numbering cylinder 2, even given limited space availability, so that a numbering and imprinting unit 1 may be reset in a relatively short time and put into operation.

Thus, the numbering cylinder 2 can be installed in and removed from the mounting position 10 on the impression cylinder 2 more easily. When removing numbering cylinder 2, conveying inclinations 9 of guide rails 7 support numbering cylinder 2 by way of the journals 6 as numbering cylinder 2 is removed; the printing press operator only has to pull the numbering cylinder 2 along the guide rails 7 because the conveying inclinations 9 direct the numbering cylinder 2 and support the numbering cylinder 2 from below. At the top of conveying inclinations 9 the half-shell-type recesses 8, shown best in FIGS. 2 and 3, support the journals 6 of the numbering cylinder 2 in a stable position, so that the numbering cylinder 2 is supported completely by the guide rails 7 without the help of the printing press operator. The printing press operator can then have both hands free to make adjustments and changes. The half-shell-shaped recesses 8 can also be described as arcs, which arcs approximate quarter-circle recesses. The shape of recesses 8 can essentially match the shape of journals 6, or the recesses 8 can have a more generic design, which generic design may not match the shape of the journals 6. A substantially important element of recesses 8 is to have a low point in which journals 6 can rest in a stable position.

Figure 4:
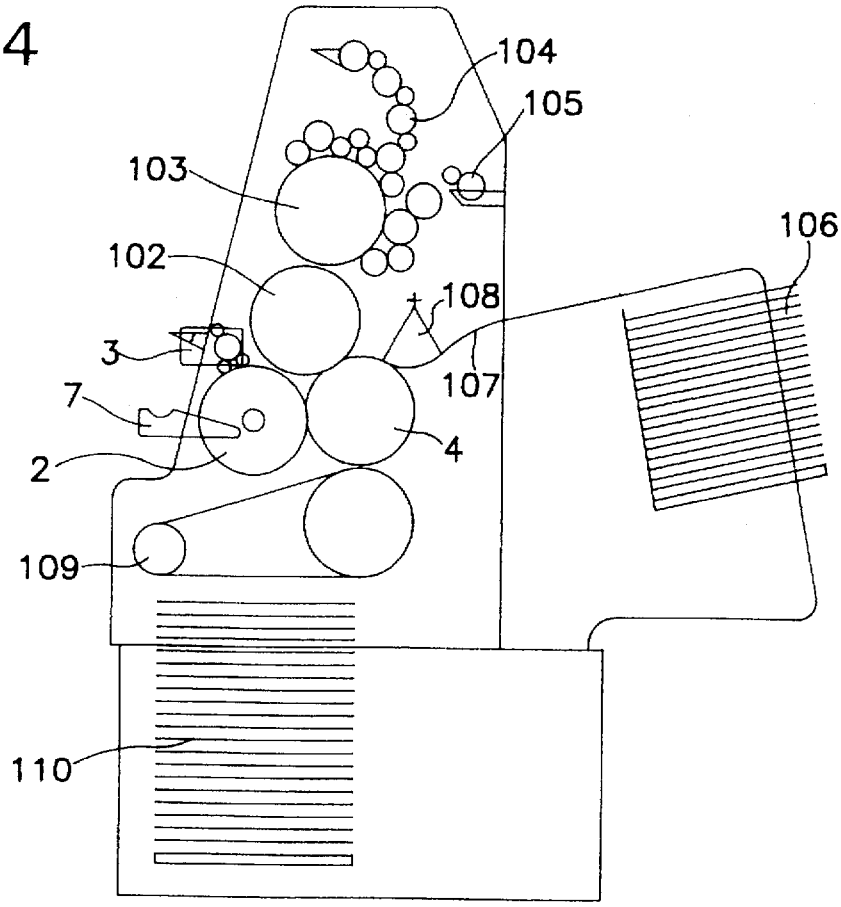
FIG. 4 is a side elevational view of a printing press with a numbering and imprinting unit in place.

FIG. 4 shows generally the overall arrangement of a sheet-fed offset printing press. As usual, the printing press consists of a printing or impression cylinder 4, a rubber cylinder or blanket cylinder 102, a plate cylinder 103, an inking mechanism 104, and a moistening mechanism 105. A paper sheet is fed to the impression cylinder 4 from the feeder pile 106 via a feed table 107 by means of a swinging gripper 108. As the sheet is carried on impression cylinder 4, rubber cylinder 102 and numbering cylinder 2 can transfer print to the sheet. The impression cylinder 4 then delivers the printed sheet to a sheet delivery 109 which passes the printed sheet on to a delivery table 110. The numbering cylinder 2 has a removable inking unit 3 for inking the numbering cylinder 2. A guide rail 7 is shown mounted on the printing press.

Figure 5:
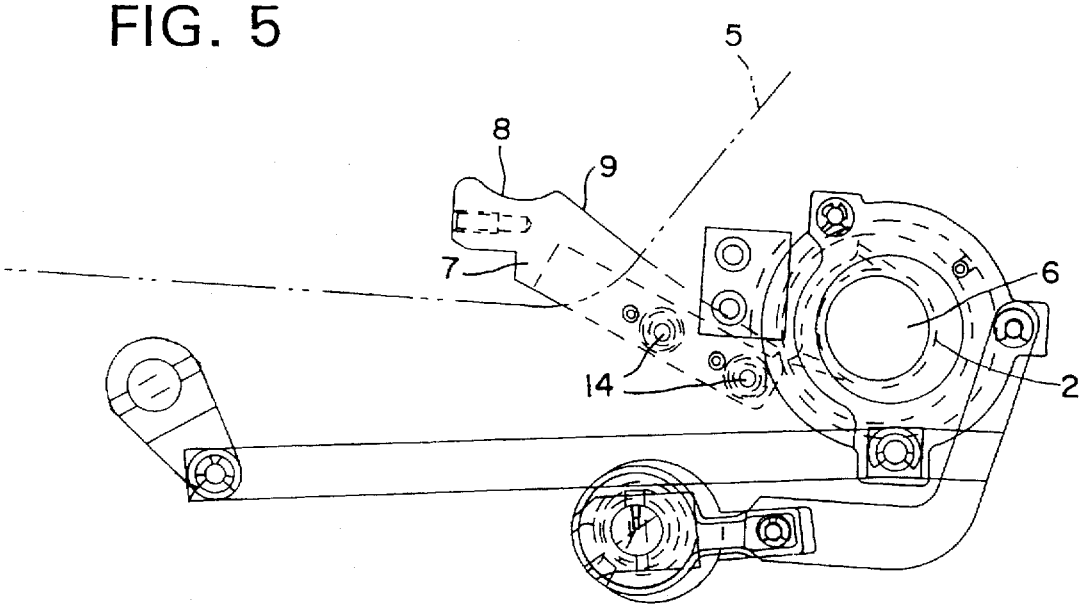
FIG. 5 is a side elevational view of a numbering unit, with the numbering cylinder being in its mounting position between the printing press side frames.

FIG. 5 is an additional view of a guide rail 7 in place on a printing press side frame 5, with the numbering cylinder 2 in the mounted position. The conveying inclination 9 and the half-shell-type recesses 8 are shown also. Guide rail 7 is mounted on printing press side frame 5 by bolts 14.

Figure 6:
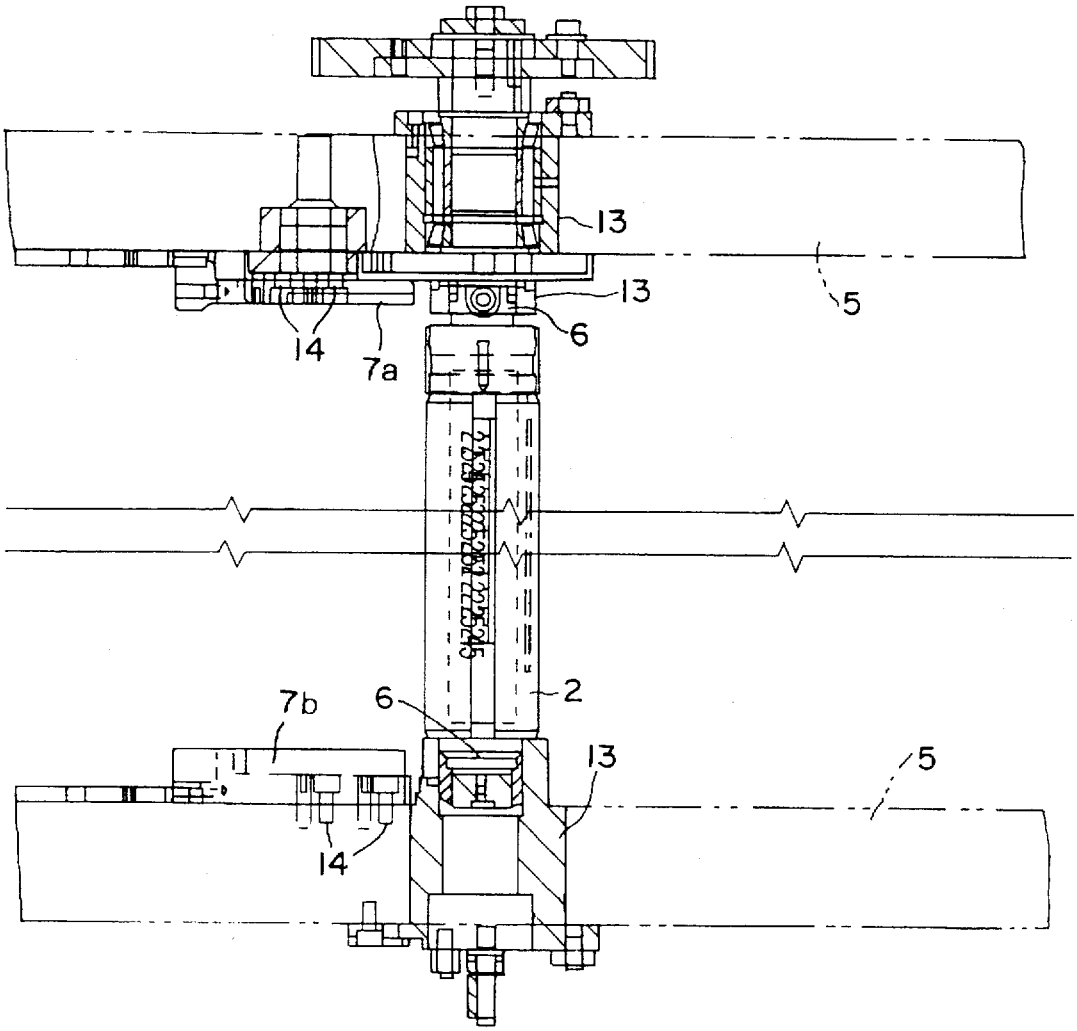
FIG. 6 is a top view of a numbering unit, with the numbering cylinder being in its mounting position between the printing press side frames.

FIG. 6 is a top view of the numbering cylinder 2 and guide rails **7*a*, 7*b* mounted on the printing press side frames 5. The journals 6 of numbering cylinder 2 are removably mounted on the printing press in bearings 13. FIG. 6 shows two guide rails 7*a* and 7*b* mounted by bolts 14 in printing press side frames 5. In the embodiment shown in FIG. 6, guide rail 7*b* is dimensioned wider than guide rail 7*a*, so that numbering cylinder 2 can be supported and guided into bearings 13** appropriately.

FIG. 1 also shows numbering cylinder 2 having three numeral elements mounted on numbering cylinder 2. The numeral elements print the numbers. Numeral elements are well known, but briefly, the numeral elements print successive numbers on successive sheets of a print job. As numbering cylinder 2 rotates about its own axis the numeral elements are engaged by control cams 11, so that the number printed by each numeral element is changed to the next appropriate number to be printed, as the numeral element passes by control cam 11. Numeral elements are well known so are not described further herein.

FIG. 1 also shows inking unit 3, for inking the numbering units of numbering cylinder 2, in a retracted position from numbering cylinder 2, which retracted position gives the press operator access to the numbering cylinder 2. The inking unit 3 is mounted on rollers to facilitate moving the inking unit 3 between the retracted position shown and an engaged position for inking the numbering cylinder 2. In addition, the inking unit 3 can be removed from the printing press side frames 5 completely by lifting the inking unit 3 from its roller tracks.

One feature of the invention resides broadly in the device for exchanging a numbering cylinder of a numbering and imprinting unit of a rotary printing press, with said numbering cylinder being engageable at an impression cylinder, and with an inking unit inking figures and/or printing block being retractable from said numbering cylinder as a unit, with bearing and drive parts provided for said numbering cylinder, firmly disposed in printing press side frames and connectable to a shaft of said numbering cylinder, characterized in that supporting and guiding elements by means of which shaft journals 6 of said numbering cylinder 2 may be moved to bearing parts in the printing press are fastened to both inner sides of said printing press are fastened to both inner sides of said printing press side frames 5.

Another feature of the invention resides broadly in the device characterized in that the supporting and guiding elements are designed as guide rails 7 featuring, with the numbering cylinder 2 being in an inserted position, half-shell-type recesses 8 for the two shaft journals 6 of said numbering cylinder 2 and adjacent conveying inclinations 9 directed downwards over which said numbering cylinder may be moved in its mounting position 10.

Examples of numbering and imprinting devices for printing presses can possibly be found in the following U.S. Pat. No. 4,577,555 entitled "Numbering device for offset press"; U.S. Pat. No. 4,625,644 entitled "Apparatus for an offset printing press"; and U.S. Pat. No. 4,353,297 entitled "Numbering printing machine for offset press".

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents recited herein, and in the Declaration attached hereto, are hereby incorporated by reference as if set forth in their entirety herein.

The corresponding foreign patent publication application, namely, Federal Republic of Germany Patent Application No. 195 16 150.5, filed on May 3, 1995, having inventor Frank Schaum is hereby incorporated by reference as if set forth in its entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A printing press with a device for installing and removing a numbering cylinder, said printing press comprising:

printing press side frames;

said printing press side frames comprising an arrangement for supporting components of said printing press;

a sheet feed device being disposed on said printing press side frames;

an impression cylinder being disposed on said printing press side frames;

a plate cylinder being disposed on said printing press side frames;

a first inking mechanism being disposed on said printing press side frames;

said first inking mechanism comprising an arrangement for inking said plate cylinder;

a blanket cylinder being disposed on said printing press side frames;

a numbering cylinder being removably disposed on said printing press side frames;

a bearing for removably mounting said numbering cylinder on said printing press side frames;

an arrangement for moving said numbering cylinder between an installed position and a removed position;

said installed position of said numbering cylinder being on said bearing;

a second inking mechanism being disposed on said printing press side frames;

said second inking mechanism comprising an arrangement for inking said numbering cylinder;

said arrangement for moving comprising an arrangement for supporting and guiding said numbering cylinder between said installed position and said removed position;

said arrangement for supporting and guiding being fixedly disposed on said printing press side frames;

said printing press side frames comprising inner surfaces, said inner surfaces being disposed adjacent said numbering cylinder in said installed position;

said arrangement for supporting and guiding being fixedly disposed on said inner surface of said printing press side frames;

said arrangement for supporting and guiding comprising at least one stationary surface;

said numbering cylinder comprising shaft journals;

said shaft journals being disposed on said bearing in said installed position; and said at least one stationary surface being disposed for and comprising an arrangement for permitting sliding of said journals on said at least one stationary surface.

2. The printing press of claim 1, wherein:

each of said at least one stationary surface comprises an inclined surface;

said inclined surface comprises a lower end and an upper end; and said lower end of said inclined surface is disposed adjacent to said bearing.

3. The printing press of claim 2, wherein:

each of said at least one stationary surface comprises a recess;

said recess is disposed adjacent to said upper end of said inclined surface; and said recess is disposed to support said numbering cylinder in said removed position.

4. The printing press of claim 3, wherein:

said recess comprises a contour;

said contour is arc shaped; and said arc shaped contour is substantially quarter-circle shaped.

5. The printing press of claim 4, wherein:

said arrangement for supporting and guiding comprises at least two stationary surfaces; and said second inking mechanism comprises an arrangement for being removably disposed on said printing press side frames.

6. A numbering and imprinting unit for a printing press, the printing press comprising side frames for supporting components of the printing press, said numbering and imprinting unit comprising:

a numbering cylinder;

a bearing for mounting said numbering cylinder on the printing press side frames and for permitting removal of said numbering cylinder from the printing press side frames;

an arrangement for moving said numbering cylinder between an installed position and a removed position;

said installed position of said numbering cylinder being on said bearing;

said arrangement for moving said numbering cylinder comprising an arrangement for supporting and guiding said numbering cylinder between said installed position and said removed position;

said arrangement for supporting and guiding comprising at least one stationary surface;

said numbering cylinder comprising shaft journals;

said shaft journals being disposed on said bearing in said installed position; and said at least one stationary surface being disposed for and comprising an arrangement for permitting sliding of said journals on said at least one stationary surface.

7. The numbering and imprinting unit of claim 6, wherein:

each of said at least one stationary surface comprises an inclined surface;

said inclined surface comprises a lower end and an upper end; and said lower end of said inclined surface is disposed adjacent to said bearing.

8. The numbering and imprinting unit of claim 7, wherein:

each of said at least one stationary surface comprises a recess;

said recess is disposed adjacent to said upper end of said inclined surface; and said recess is disposed to support said numbering cylinder in said removed position.

9. The numbering and imprinting unit of claim 8, wherein:

said recess comprises a contour; and said contour is arc shaped.

10. The numbering and imprinting unit of claim 9, wherein:

said arc shaped contour is substantially quarter-circle shaped.

11. The numbering and imprinting unit of claim 8, wherein:

said recess comprises a contour;

said journals comprise a contour; and said journal contour is dimensioned to substantially conform to said recess contour.

12. The numbering and imprinting unit of claim 13, wherein:

said arrangement for supporting and guiding comprises at least two stationary surfaces;

said numbering and imprinting unit further comprises:

an inking mechanism; and an arrangement for disposing said inking mechanism on the printing press side frames;

said inking mechanism comprises an arrangement for inking said numbering cylinder; and said arrangement for disposing said inking mechanism on the printing press side frames comprises an arrangement for removably disposing said inking mechanism on the printing press side frames.

13. The numbering and imprinting unit of claim 6, wherein said numbering and imprinting unit comprises:

an arrangement for fixedly disposing said supporting and guiding arrangement on the printing press side frames;

the printing press side frames comprising inner surfaces;

said numbering cylinder being disposed adjacent the inner surfaces of the printing press side frames in said installed position; and said arrangement for fixedly disposing comprising an arrangement for fixedly disposing said support and guide arrangement on the inner surface of the printing press side frames.

14. The numbering and imprinting unit of claim 13, wherein:

each of said at least one stationary surface comprises an inclined surface;

said inclined surface comprises a lower end and an upper end; and said lower end of said inclined surface is disposed adjacent to said bearing.

15. The numbering and imprinting unit of claim 14, wherein:

each of said at least one stationary surface comprises a recess;

said recess is disposed adjacent to said upper end of said inclined surface;

said recess is disposed to support said numbering cylinder in said removed position;

said recess comprises a contour; and said contour is arc shaped.

16. A device for installing and removing a numbering cylinder of a numbering and imprinting unit for a printing press, the printing press comprising side frames for supporting components of the printing press, the printing press side frames comprising inner surfaces, the numbering and imprinting unit comprising: a numbering cylinder; the numbering cylinder comprising shaft journals; a bearing for mounting the shaft journals of the numbering cylinder on the printing press side frames and for permitting removal of the numbering cylinder from the printing press side frames; said device for installing and removing a numbering cylinder comprising:

an arrangement for moving the numbering cylinder between an installed position and a removed position;

the shaft journals of the numbering cylinder being disposed on the bearing in said installed position;

the numbering cylinder being disposed adjacent the inner surfaces of the printing press side frames in said installed position;

said moving arrangement comprising an arrangement for supporting and guiding the numbering cylinder between said installed position and said removed position;

an arrangement for fixedly disposing said support and guide arrangement on the inner surfaces of the printing press side frames;

said arrangement for supporting and guiding comprising at least one stationary surface; and said at least one stationary surface being disposed for and comprising an arrangement for permitting sliding of said journals on said at least one stationary surface.

17. The device for installing and removing a numbering cylinder of claim 16, wherein:

each of said at least one stationary surface comprises an inclined surface;

said inclined surface comprises a lower end and an upper end; and said lower end of said inclined surface is disposed adjacent to said bearing.

18. The device for installing and removing a numbering cylinder of claim 17, wherein:

each of said at least one stationary surface comprises a recess;

said recess is disposed adjacent to said upper end of said inclined surface; and said recess is disposed to support said numbering cylinder in said removed position.

19. The device for installing and removing a numbering cylinder of claim 18, wherein:

said recess comprises a contour;

said contour is arc shaped; and said arc shaped contour is substantially quarter-circle shaped.

20. The device for installing and removing a numbering cylinder of claim 19, wherein the numbering and imprinting unit further comprises: an inking mechanism; an arrangement for removably disposing the inking mechanism on the printing press side frames; the inking mechanism comprises an arrangement for inking the numbering cylinder; wherein:

said arrangement for supporting and guiding comprises at least two stationary surfaces.

* * * * *

UNITED STATES PATENT AND TRADEMARK OFFICE

CERTIFICATE OF CORRECTION

PATENT NO. : 5,752,440

DATED : MAY 19, 1998

INVENTOR(S) : Frank SCHAUM

It is certified that error appears in the above-identified patent and that said Letters Patent is hereby corrected as shown below:

In column 8, line 9, Claim 12, after 'claim', delete "13," and insert --10,--.

Signed and Sealed this

Twenty-fifth Day of August, 1998

Bruce Lehman

*Attest:*

BRUCE LEHMAN

*Attesting Officer*

*Commissioner of Patents and Trademarks*